US005311488A

United States Patent [19]

Trantham

[11] Patent Number: 5,311,488

[45] Date of Patent: May 10, 1994

[54] ACTION ALARM CLOCK

[75] Inventor: Herbert B. Trantham, Discovery Bay, Hong Kong

[73] Assignee: With Design In Mind, Chatsworth, Calif.

[21] Appl. No.: 994,283

[22] Filed: Dec. 21, 1992

[51] Int. Cl.[5] ..... G04B 47/00

[52] U.S. Cl. ..... 368/250; 368/12; 368/257; 368/262; 368/265; 368/272; 368/72

[58] Field of Search ..... 368/223-239, 368/272, 274, 250-270

[56] References Cited

PUBLICATIONS

Stress Relief Train (copy of portions of box).

The Paragon Holiday II 1992 catalog, 3 pages.

*Primary Examiner*—Bernard Roskoski

[57] ABSTRACT

An alarm clock is provided which coordinates mechanical motion or action with a distinctive sound, when the alarm clock reaches a set alarm time. The action alarm clock includes an elongated base defining a linear track for movement of an object such as a train engine between end stops when the alarm clock reaches the set alarm time. Such movement is accompanied by an audible sound comprising a novelty sound chosen to correspond with the nature of the moving object. When the moving object reaches a front end stop, the sound is terminated and a regular alarm clock signal is enabled.

8 Claims, 4 Drawing Sheets

ACTION ALARM CLOCK

FIELD OF THE INVENTION

This invention relates generally to a novelty alarm clock. More specifically, this invention relates to an action alarm clock which coordinates mechanical motion or action with a distinctive sound, such motion and sound being activated when the alarm clock reaches a set alarm time.

BACKGROUND OF THE INVENTION

Alarm clocks are the bane of most working people. Most work on the principle that when a set alarm time is reached, an alarm or music sounds. Manufacturers try to make the alarms so annoying that they cannot be ignored. Once the stop button is depressed, the alarm-/music immediately discontinues.

Some alarm clocks are equipped with the ever-popular "snooze" button, depression of which also immediately shuts off the alarm allowing one to "snooze" a few more minutes until the alarm sounds again. Unfortunately, depression of the snooze button becomes so automatic and repetitive that the original set alarm time becomes meaningless. People also can become so accustomed to the alarm/music that they sleep through it. As a result, appointments, deadlines, and schedules are often missed.

The present invention provides an alternative alarm clock including a moving object which travels along a track to a destination when a set alarm time is reached, and wherein this motion is accompanied by a distinctive sound correlated with the moving object. This distinctive sound is sustained over a period of time until the moving object has reached its destination, at which time a normal clock alarm is activated.

SUMMARY OF THE INVENTION

According to the present invention and exemplary embodiment thereof described herein, an action alarm clock is provided which coordinates mechanical motion or action with a distinctive sound, the motion and sound being activated when the alarm clock reaches a set alarm time. The action alarm clock comprises, generally, an elongated base defining a linear track for movement of a object between front and rear end stops when the alarm clock reaches the set alarm time. Such movement is accompanied by an audible sound which is correlated with the moving object. When the moving object reaches the end of the track, the object-related sound is terminated and a normal alarm clock signal is enabled.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
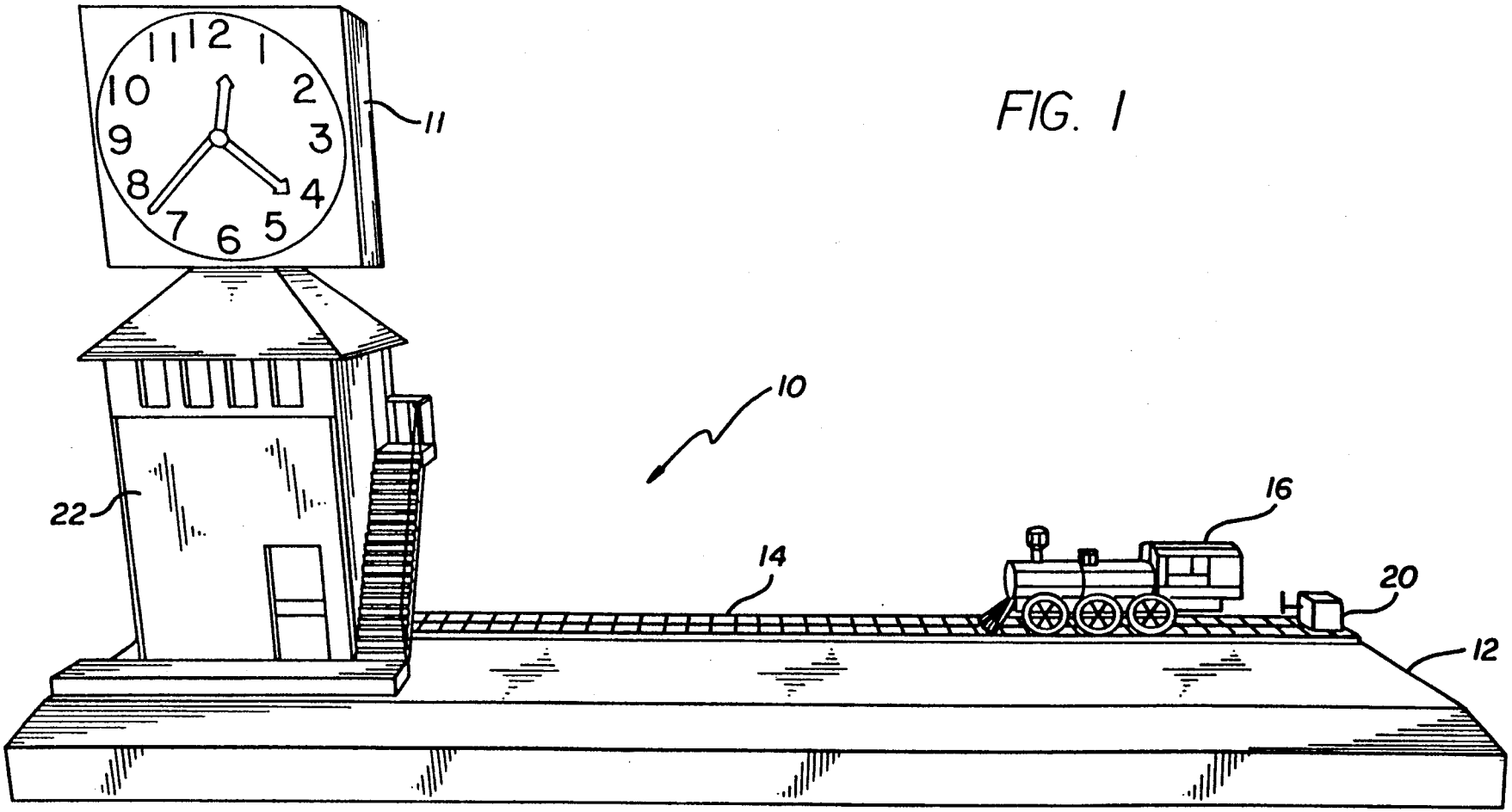
FIG. 1 generally shows the preferred embodiment in front elevation, to include an elongated base defining a linear track for movement of a train engine between end stops, in combination with an alarm clock mounted on top of a building structure at one end of the track.
Figure 2:
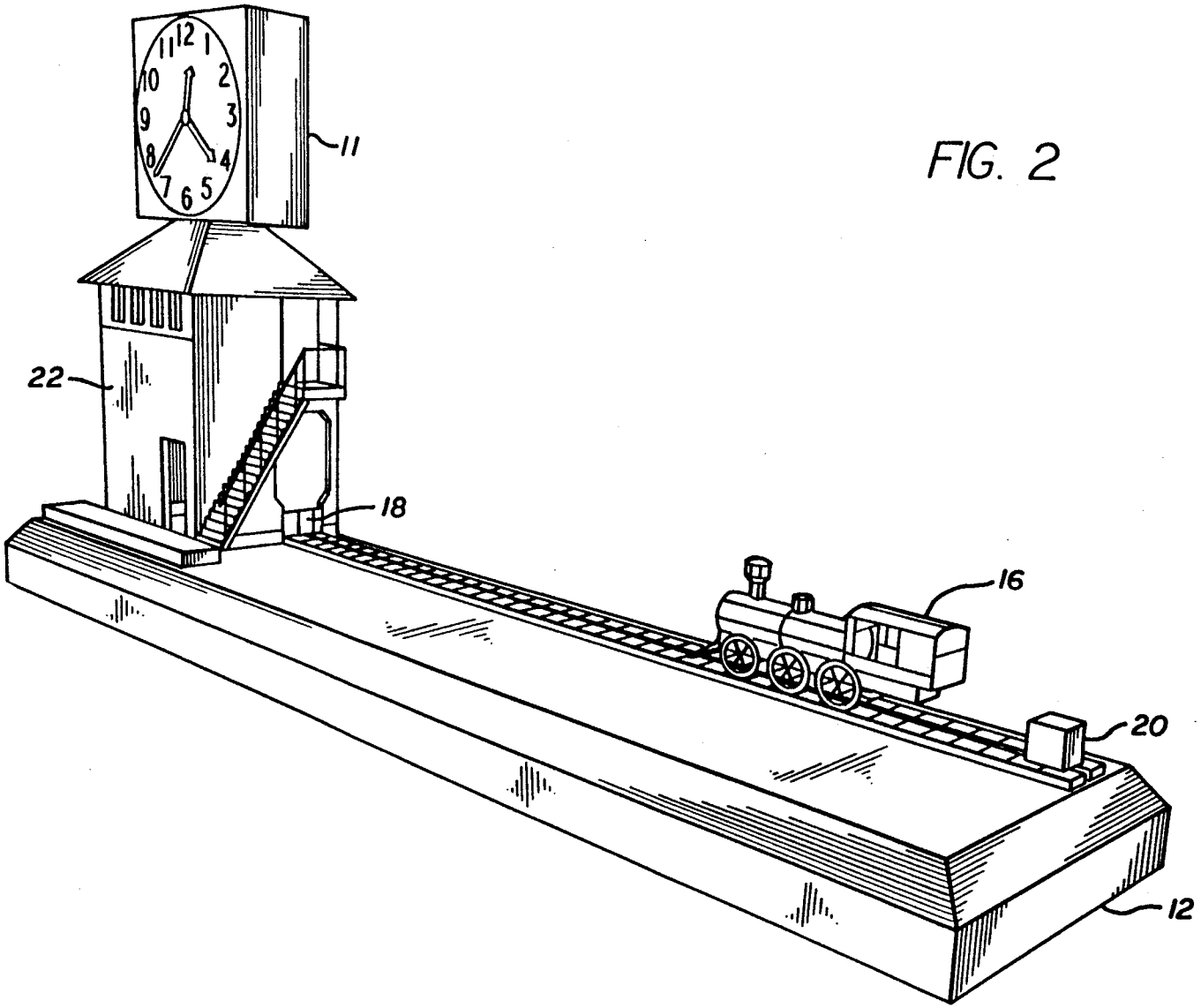
FIG. 2 is a perspective view similar to FIG. 1, illustrating the track end stops.

As shown in the drawings for purposes of illustration, an action alarm clock referred to generally in FIG. 1 by the reference numeral 10 is provided for coordinating mechanical motion or action with an audible sound when a set alarm time is reached.

In accordance with the present invention, and as illustrated with respect to a preferred embodiment in FIGS. 1–4, the action alarm clock 10 generally comprises a conventional alarm clock 11, an elongated base 12 defining a linear track 14 for movement of a train engine 16 thereon when the alarm clock 11 reaches the set alarm time, in coordination with an audible train sound. When the train engine 16 reaches the end of the track, the train sound is terminated and a regular or normal clock alarm is enabled. The audible train sound comprises in the preferred form a train chugging along a track including novelty whistle blowing, and bell-clanging locomotive sounds.

The train engine is adapted to move along the track 14 between front and rear end stops 18 and 20. The front end stop 18 is housed within a structure 22 (FIG. 2) in the form of a building, constituting a caricature of a train environment such as a railroad station. The clock 11 is mounted in any convenient manner on top of the building structure 22, and an analog or digital clock of electrically powered design may be used. In this regard, the clock 11 and related components such as the train engine 16 and the train sounds can be powered by a battery power supply, or by plug-in connection to a household electrical circuit.

Figure 3:
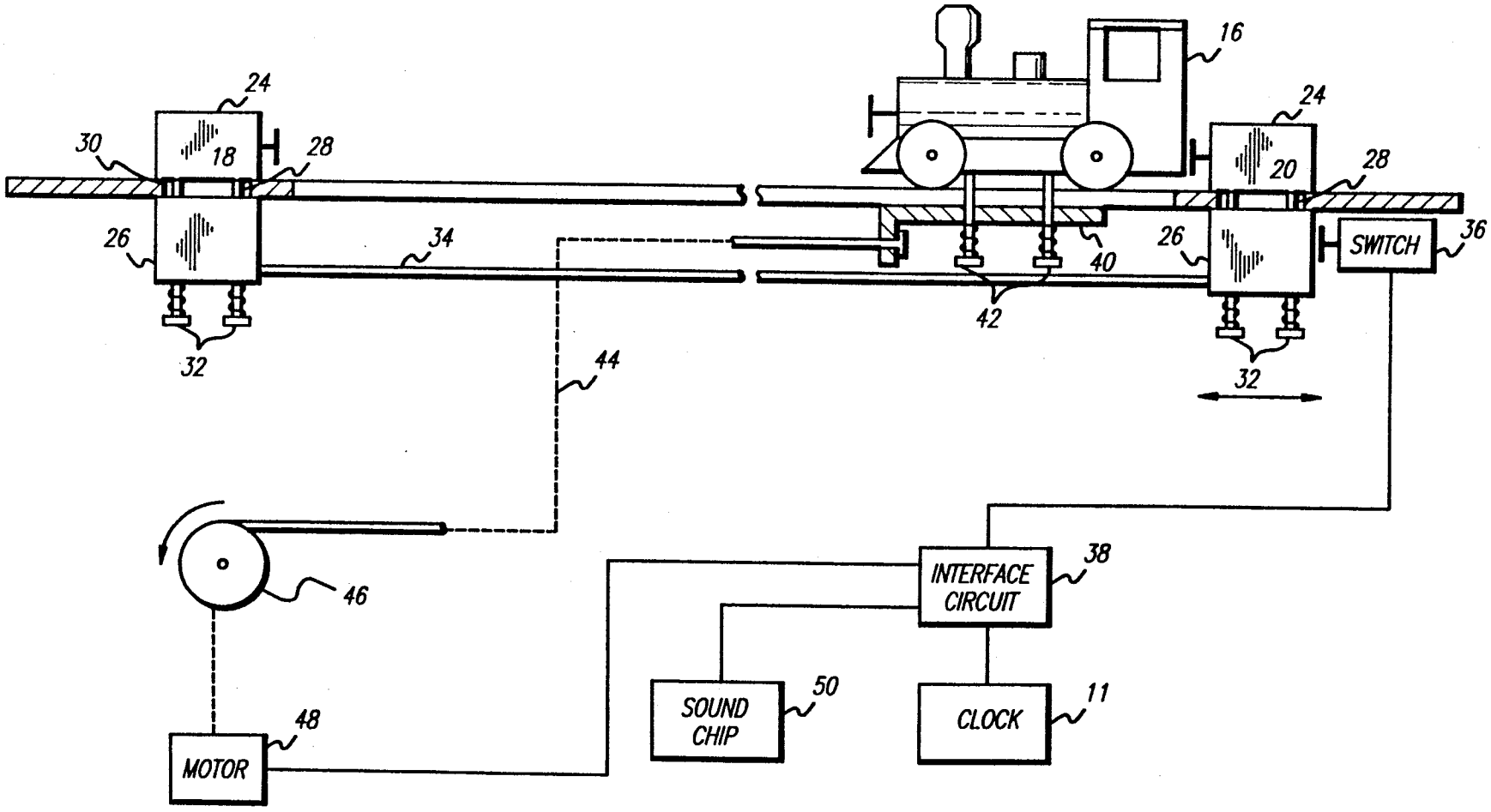
FIG. 3 is a schematic electromechanical diagram, illustrating generally the arrangement of the train engine on the track.

As shown in FIG. 3, the end stops 18 and 20 include upper and lower housing portions 24 and 26 interconnected by pins 28 extending through slots 30 in the base 12. Compression springs 32 react against portions of the end stops for urging the stops into frictional engagement with the base 12. A rigid bar 34 extends between the end stops 18 and 20 in a concealed position beneath the track-defining base 12.

Figure 4:
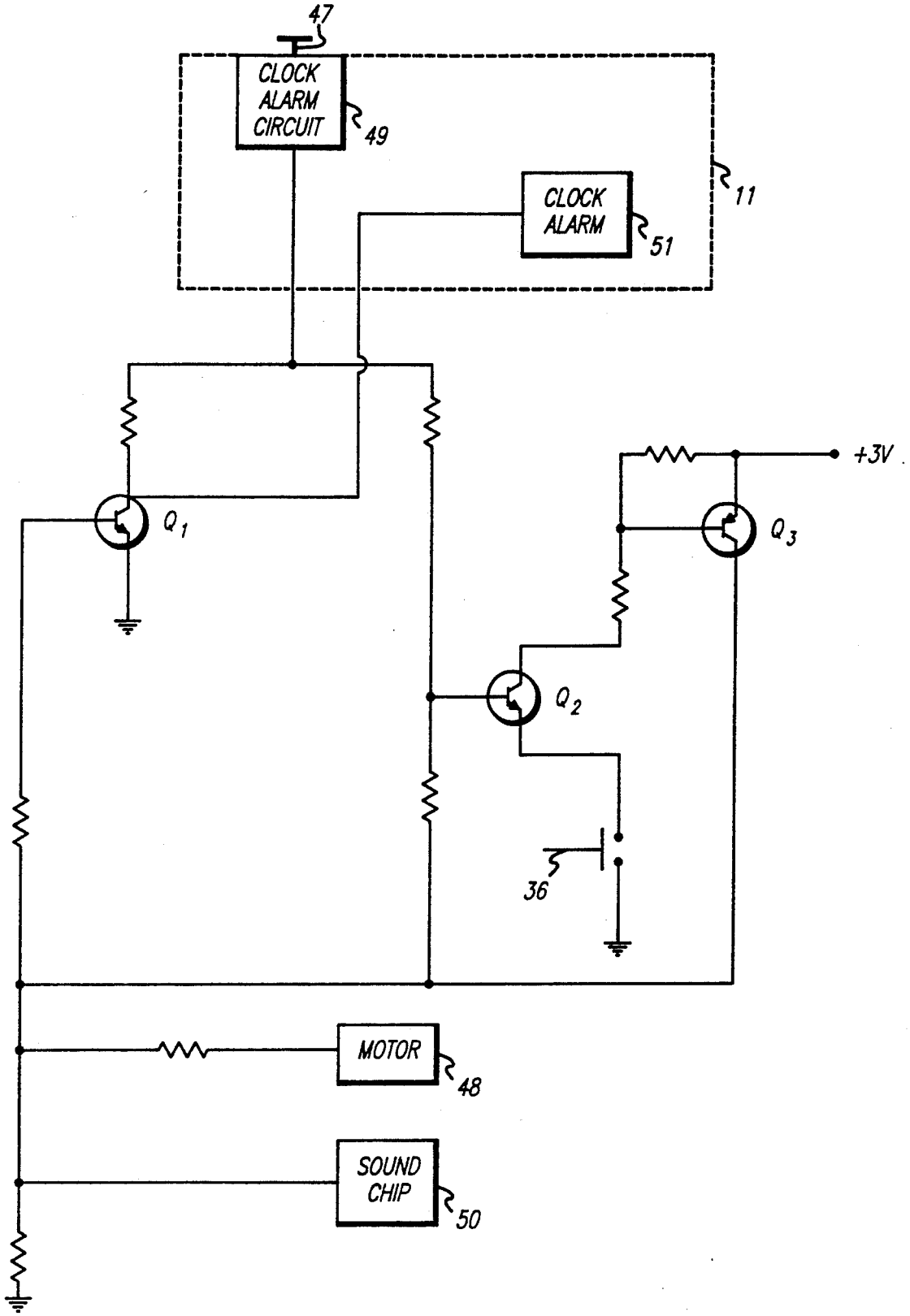
FIG. 4 is a control circuit diagram.

The train engine 16 is adapted to be manually moved rearwardly in a sliding manner along the track to engage the rear end stop 20. When this occurs, the stop 20 and interconnecting bar 34 are displaced rearwardly through a short stroke to depress and close a bumper switch 36 (FIG. 3). The bumper switch 36 activates the interface control circuitry 38, as will be described and as shown in FIG. 4. The friction engagement of the end stop with the base maintains the bumper switch 36 in the closed position until the front end of the train pushes against the front end stop 18 at the opposite end of the track. This shifts the entire end stop structure toward an opposite position, preventing spring-loaded retraction of the bumper switch 36 to an open position.

As shown further in FIG. 3, the train engine 16 is carried on a slide plate 40 mounted beneath the track, with spring loaded pins 42 again maintaining a frictional engagement between the slide plate 40 and the track 14. A cable 44 extends forwardly from the slide plate 40 and is wrapped around a cable reel 46. The reel 46 is adapted to be driven by an electric motor 48 for purposes of drawing the train engine 16 down the track 14. The motor 48 is equipped with a slip clutch (not shown) so that the train engine 16 can be manually moved rearwardly.

With reference to FIG. 4, retraction of the train to the rearmost position moves the bumper switch 36 to the closed position. The bumper switch 36 is adapted to connect the emitter of transistor switch Q2 to ground, for purposes of enabling the transistor Q2. This enablement, by itself, does not provide a positive voltage to the base of Q2, and thus does not switch Q2 to an "on" state, because of (a) transistor Q3 is still in an "off" condition, thus preventing application of positive voltage to the base of Q2, and (b) the set time for the clock alarm has not yet been reached, whereby the clock alarm circuit has not supplied a positive voltage to the base of transistor Q2. The train engine 16 is thus set in an armed position, waiting for the set alarm time to occur.

When the set alarm time is reached, a clock alarm circuit 49 provided as part of the clock 11 supplies a positive voltage to the base of transistor Q2, to switch the transistor to Q2 to an "on" state. When this occurs, virtually instantaneously, positive voltage is coupled to the base of transistor Q3, which also switches to an "on" state and thus provides the positive voltage signal from the collector side of Q3 as an additional input to the base of transistor Q2. This collector (Q3) to base (Q2) signal effectively constitutes a latching signal which allows the positive voltage to pass directly through the emitter-collector junctions of transistor Q3 to the base of Q2, thus latching and maintaining Q2 in the "on" state, even though the clock alarm circuit voltage might be turned off, for example, by manual depression of the standard clock alarm switch 47 when the person wakes up.

Supply of the positive voltage via the latching circuit to the base of transistor Q2, also supplies the same positive voltage to the train drive motor 48 and to a sound chip 50, thus initiating train operation and train sounds. Importantly, during this period of train operation and train sound, positive voltage is also supplied to the base of transistor Q1, which switches to an "on" state, thus rerouting the normal clock alarm activation signal through the collector-emitter junctions of transistor Q1, thus preventing passing of that signal to the clock alarm 51 and thereby also preventing the clock alarm from sounding.

When the train reaches the opposite end stop 18 as viewed in FIG. 3, the mechanical stop assembly shifts to a second position which accommodates spring-loaded retraction of the bumper switch 36 to the open position. This spring-loaded retraction of the bumper switch 36 instantly turns Q2 to an "off" state, and thus also switches Q3 and Q1 to "off" states. Importantly, if the clock alarm voltage signal is still present, i.e. if the main clock alarm switch 47 has not been depressed, the "off" state of transistor Q2 permits that alarm signal to pass directly to the clock alarm 51 and thereby activate the clock alarm. In a typical form, the clock alarm 51 sounds a buzzer or bell.

Accordingly, in sequence, the train engine 16 is retracted manually to the alarm state with the bumper switch 36 closed, awaiting the alarm clock to reach a preset alarm time. When the time is reached, the train engine 16 begins to advance along the track 14 in conjunction with the train sound. When the train reaches the opposite end stop, train motion and train sound stop, but the clock alarm 51 is enabled. The alarm will sound unless and until the clock alarm switch is depressed.

Importantly, depression of the clock alarm switch before the train engine reaches the front end stop 18 will not interrupt train sound or train motion until the end stop is reached. This continuation of train motion for the duration of track length is the result of the latching circuit function.

This invention has been described with a train engine, train sounds, and the building structure in the form of a railroad station. Of course, other moving or action objects including, but not limited to other vehicles accompanied by audible sound in other correlative environments may be used within the scope and spirit of the invention. For example, the moving or action object could be a clown on a bicycle, in combination with a circus or laughter sounds, etc. and the building structure a circus tent. Another example is a race car accompanied by the sound of a car zooming on a track with the engine sounds of a crowded speedway and the building structure a pit stop.

Although a particular embodiment of the invention has been described in detail for purposes of illustration, various modifications may be made without departing from the spirit and scope of the invention. Accordingly, the invention is not to be limited, except as by the appended claims.

What is claimed is:

1. An action alarm clock, comprising:

a clock having means to display time;

a clock set to activate at a set alarm time;

means defining an elongated and linear track;

a vehicle adapted to begin movement from a start point toward a set termination point along said track when the set alarm time is reached; and means for generating an audible sound associated with the moving vehicle as the vehicle moves along the track, and for terminating the audible sound when the vehicle reaches the set termination point wherein said clock further includes an audible clock alarm, and means for activating said clock alarm when said audible sound associated with the moving vehicle is terminated.

2. The action alarm clock of claim 1, wherein said vehicle is a train.

3. The action alarm clock of claim 1, wherein said vehicle is a train and said audible sound comprises locomotive sounds.

4. The action alarm clock of claim 1, wherein a miniature building structure is associated with said set termination point.

5. The action alarm clock of claim 4, wherein said building structure is a train station.

6. The action alarm clock of claim 4, wherein said building structure and said vehicle are of a type having an associated design theme.

7. A novelty alarm clock, comprising:

a clock having a visible time display, an audible clock alarm, and alarm set means for activation at a particular set alarm time;

means for defining an elongated and linear track;

a vehicle adapted to begin movement from a start point toward a set termination point along said track when the set alarm time is reached;

means for generating an audible sound associated with the vehicle as the vehicle moves along the track, and for terminating said sound when the vehicle reaches the set termination point; and means for activating said clock alarm when the vehicle reaches the set termination point.

8. The novelty alarm clock of claim 7, further comprising deactivation means having a first upright and a second depressed position, the second position preventing activation of the clock alarm but permitting movement of the vehicle along the track to the set termination point.

* * * * *